United States Patent [19]

Taylor

[11] Patent Number: 4,669,725

[45] Date of Patent: Jun. 2, 1987

[54] DIRECTIONAL DEVICE FOR GOLFERS

[76] Inventor: Thomas Taylor, 7767 Kyles Station Rd., Middletown, Ohio 45044

[21] Appl. No.: 826,993

[22] Filed: Feb. 7, 1986

[51] Int. Cl.[4] ..... A63B 57/00

[52] U.S. Cl. ..... 273/33; 273/203

[58] Field of Search ..... 273/33, 203

[56] References Cited

U.S. PATENT DOCUMENTS

| | | | |
|---|---|---|---|
| 1,596,110 | 8/1926 | Lynch | 273/33 |
| 1,761,532 | 6/1930 | Morris | 273/33 |
| 2,074,519 | 3/1937 | Shephard | 273/203 |
| 2,451,311 | 10/1948 | Andreasen, Sr. | 273/33 |
| 2,555,222 | 5/1951 | Coleman et al. | 273/203 |
| 3,325,168 | 6/1967 | Fyanes | 273/33 |
| 3,347,551 | 10/1967 | Dreyfus | 273/33 |
| 3,448,984 | 6/1969 | Dreyfus | 273/33 |
| 3,467,390 | 9/1969 | Gardiner | 273/183 A |
| 3,883,144 | 5/1975 | Lazow | 273/183 A |
| 4,328,969 | 5/1982 | Wright | 273/203 |

*Primary Examiner*—Richard C. Pinkham
*Assistant Examiner*—T. Brown
*Attorney, Agent, or Firm*—Darrell F. Marquette; Jack C. McGowan

[57] ABSTRACT

A directional device (10) to be used while playing golf includes a modified golf tee (12) and a standard golf tee (14) which are assembled together by removably inserting the pointed end (24) of the standard golf tee (14) into a hole (28) formed in the enlarged head (20) of the modified golf tee (12). The standard golf tee (14) is then aimed at a desired target such as a flagstick on a green when the pointed end (18) of the modified golf tee (12) is inserted into the ground and the enlarged head (20) of the modified golf tee (12) is positioned to support a golf ball.

6 Claims, 5 Drawing Figures

Fig. 1
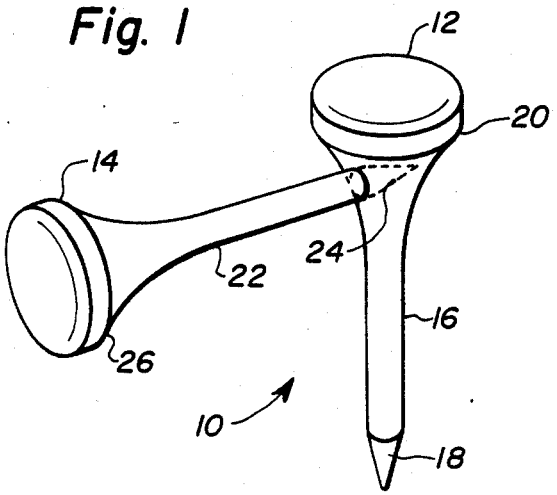
Fig. 2
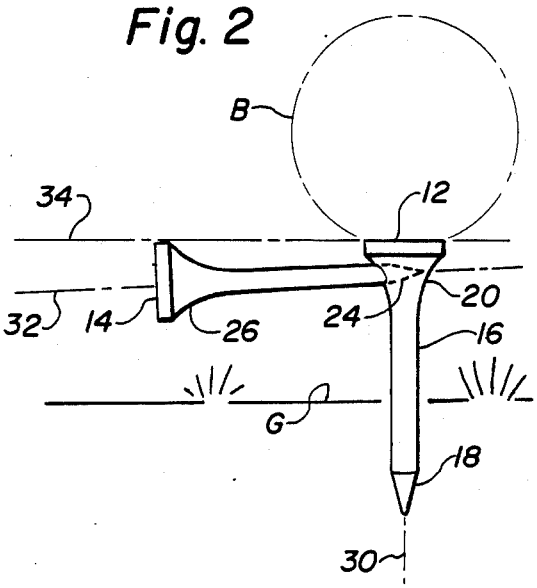
Fig. 3
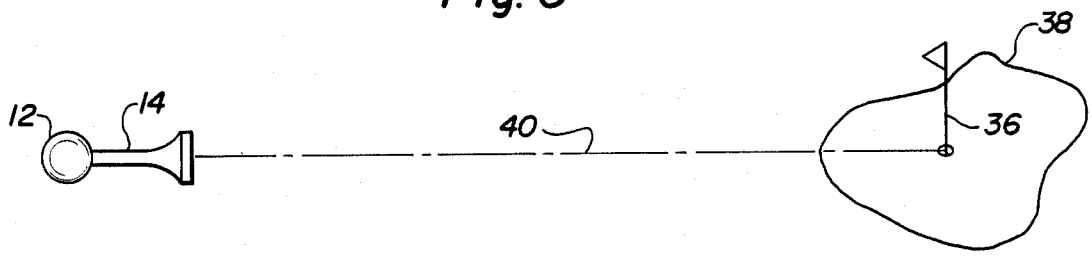
Fig. 4
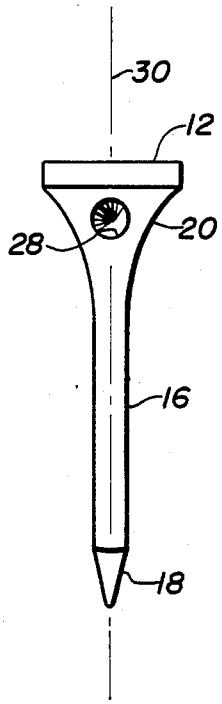
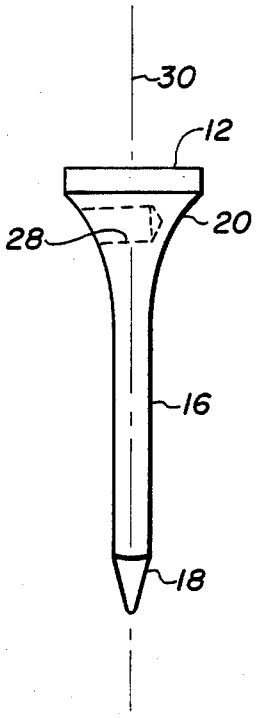
Fig. 5

DIRECTIONAL DEVICE FOR GOLFERS

BACKGROUND OF THE INVENTION

This invention relates generally to golf equipment and, in particular, to a directional device to be used while playing golf.

Many golfers have difficulty properly lining up their shots, especially their drives or tee shots which are usually aimed at targets that are a considerable distance away. This problem has generally been overcome by using directional devices to line up tee shots. Such directional devices have proven helpful to both experienced and inexperienced golfers.

In the past, various types of directional devices have been invented to aid golfers in lining up their tee shots. For example, U.S. Pat. No. 3,347,551 discloses pointers which are adapted to be mounted in grooves formed in golf tees and then aimed at a desired target when the tees are inserted into the ground. U.S. Pat. No. 3,883,144 discloses a golf tee with an attached pointer to indicate the desired line of flight of a golf shot. U.S. Pat. No. 2,451,311 discloses a golf tee having two legs arranged so that when one of the legs is stuck in the ground, the other leg may be pointed toward the target. A common drawback of the directional devices disclosed in the aforementioned patents is that they are too expensive and difficult to manufacture.

SUMMARY OF THE INVENTION

It is an object of the present invention to provide a directional device that is effective in helping golfers properly line up their tee shots.

It is a further object of the present invention to provide a directional device for golfers which may be easily manufactured at a relatively low cost.

It is another object of the present invention to provide a directional device which may be easily assembled for use by golfers.

The present invention accomplishes these objects by providing a directional device for golfers that includes first and second golf tees assembled together. The first golf tee has a shank portion, a pointed end adapted to be inserted into the ground, and an enlarged head adapted for supporting a golf ball. The second golf tee also has a shank portion, a pointed end, and an enlarged head. The pointed end of the second golf tee is removably inserted into the enlarged head of the first golf tee in order to assemble the directional device, and then the second golf tee which extends outwardly from the first golf tee is aimed at a target when the pointed end of the first golf tee is inserted into the ground and the enlarged head of the first golf tee is positioned to support a golf ball.

In the preferred embodiment of the directional device, the enlarged head of the first golf tee has a hole formed therein for receiving the pointed end of the second golf tee. This hole extends generally transverse and is inclined at a slight downward angle with respect to the longitudinal axis of the first golf tee. The downward inclination of the hole causes the enlarged head of the second golf tee to be disposed entirely below the top of the enlarged head of the first golf tee when the directional device is assembled and the pointed end of the first golf tee is inserted into the ground.

DESCRIPTION OF THE DRAWINGS

FIG. 1 is a perspective view of a directional device according to the preferred embodiment of the present invention;

FIG. 2 is a side elevation view of the directional device of FIG. 1 taken when it is in use supporting a golf ball above the ground;

FIG. 3 is a top plan view of the directional device of FIG. 1 showing it aimed at a target; and FIGS. 4 and 5 are further views of a golf tee modified for use in the directional device of FIG. 1.

DESCRIPTION OF THE INVENTION

Referring to FIGS. 1 and 2, a directional device 10 according to the preferred embodiment of the present invention includes a golf tee 12 modified as described hereafter and a standard golf tee 14. Both of these golf tees 12 and 14 may be made of wood or plastic as desired. The golf tee 12 has a shank portion 16, a pointed end 18 adapted to be inserted into the ground as shown in FIG. 2, and an enlarged head 20 adapted for supporting a golf ball B as also shown in FIG. 2. The golf tee 14, likewise, has a shank portion 22, a pointed end 24, and an enlarged head 26.

The directional device 10 is assembled by removably inserting the pointed end 24 of the golf tee 14 into a hole 28 (best shown in FIGS. 4 and 5) formed in the enlarged head 20 of the golf tee 12. The hole 28 may be formed in the golf tee 12 by drilling or, if the golf tee 12 is made of plastic, the hole 28 may be molded into the golf tee 12. The hole 28 extends generally transverse and is inclined at a slight downward angle with respect to the longitudinal axis 30 of the golf tee 12. This downward inclination of the hole 28 allows a golf ball to safely pass over the enlarged head 26 of the golf tee 14 without hitting it when the directional device 10 is in use.

With the directional device 10 assembled as already described, the pointed end 18 of the golf tee 12 is inserted into the ground and the enlarged head 20 of the golf tee 12 is positioned to support a golf ball. As seen in FIG. 2, the longitudinal axis 30 of the golf tee 12 lies substantially perpendicular to the surface of the ground G while the longitudinal axis 32 of the golf tee 14 is inclined at a slight angle to the surface of the ground G. The golf tee 14 extends outwardly from the golf tee 12, and the enlarged head 26 of the golf tee 14 is disposed entirely below the top of the enlarged head 20 of the golf tee 12 which is represented by the line 34 in FIG. 2. The directional device 10 is positioned with the golf tee 14 aimed as shown in FIG. 3 at a target such as a flagstick 36 on a green 38. The directional device 10 is now ready to be used by a golfer with the result that his tee shot will be in alignment with the target.

Referring particularly to FIG. 3, it will be understood that an important advantage of the directional device 10 is that a golfer will be able to visualize the desired line of flight 40 of his tee shot. This will assist the golfer in properly positioning his feet and his golf club for an accurate shot.

The present invention provides an improved directional device for golfers which may be easily and economically manufactured, and which is easily assembled and used by golfers to properly line up tee shots.

It should be understood that the directional device of the present invention is not limited to a combination of a modified golf tee, e.g. golf tee 12, and a standard golf tee, e.g. golf tee 14. Accordingly, the directional device may be comprised of two such modified golf tees, if desired.

While the preferred embodiment of the present invention has been disclosed herein, it will be understood that the following claims also cover other embodiments and modifications of the present invention. For example, in an alternative embodiment not shown, the hole 28 would extend completely through the enlarged head 20 of the golf tee 12 rather than only partially through the enlarged head 20 of golf tee 12 as in the preferred embodiment shown in FIG. 5.

What is claimed is:

1. A directional device for golfers comprising:

a first golf tee having a shank portion, a pointed end adapted to be inserted into the ground, and an enlarged head adapted for supporting a golf ball, the enlarged head of said first golf tee having a hole formed therein;

a second golf tee also having a shank portion, a pointed end and an enlarged head, said second golf tee having the same shape and general configuration as said first golf tee, the pointed end of said second golf tee being removably insertable into said hole in the enlarged head of said first golf tee in order to assemble and disassemble the directional device; and said second golf tee extending outwardly from said first golf tee for being aimed at a target when the directional device is assembled by inserting the pointed end of said second golf tee into said hole in the enlarged head of said first golf tee and when the pointed end of said first golf tee is inserted into the ground and the enlarged head of said first golf tee is positioned to support a golf ball.

2. The directional device of claim 1 wherein said hole extends generally transverse and is inclined at a slight downward angle with respect to the longitudinal axis of said first golf tee.

3. The directional device of claim 2, wherein the enlarged head of said second golf tee is disposed entirely below the top of the enlarged head of said first golf tee when the directional device is assebled and the pointed end of said first golf tee is inserted into the ground.

4. The directional device of claim 3, wherein the longitudinal axis of said first golf tee lies substantially perpendicular to the surface of the ground while the longitudinal axis of said second golf tee is inclined at a slight angle to the surface of the ground when the directional device is assembled and in use.

5. The directional device of claim 1, wherein said first and second golf tees are made of wood.

6. The directional device of claim 1, wherein said first and second golf tees are made of plastic.

* * * * *